US008618956B2

(12) United States Patent
Bragagnini et al.

(10) Patent No.: US 8,618,956 B2
(45) Date of Patent: Dec. 31, 2013

(54) METHOD AND SYSTEM FOR DETECTING A MOVING VEHICLE WITHIN A PREDETERMINED AREA

(75) Inventors: Andrea Bragagnini, Turin (IT); Elisa Alessio, Turin (IT); Maura Santina Turolla, Turin (IT); Roberta Manzueto, Procida (IT)

(73) Assignee: Telecom Italia S.p.A., Milan (IT)

( * ) Notice: Subject to any disclaimer, the term of this patent is extended or adjusted under 35 U.S.C. 154(b) by 914 days.

(21) Appl. No.: 12/452,372

(22) PCT Filed: Jun. 28, 2007

(86) PCT No.: PCT/EP2007/005723

§ 371 (c)(1),
(2), (4) Date: Mar. 29, 2010

(87) PCT Pub. No.: WO2009/000301

PCT Pub. Date: Dec. 31, 2008

(65) Prior Publication Data

US 2010/0203834 A1 Aug. 12, 2010

(51) Int. Cl.
*G08G 1/123* (2006.01)

(52) U.S. Cl.
USPC ..... 340/988; 455/41.2; 705/4

(58) Field of Classification Search
USPC ..... 340/988, 989, 539.13, 10.1; 455/422, 455/426, 456, 99, 41.2, 404.2; 705/4; 713/176; 342/450, 457
See application file for complete search history.

(56) References Cited

U.S. PATENT DOCUMENTS

| | | | |
|---|---|---|---|
| 5,083,200 | A | 1/1992 | Deffontaines |
| 5,319,962 | A | 6/1994 | Kaminski et al. |
| 5,933,096 | A | 8/1999 | Tsuda |

(Continued)

FOREIGN PATENT DOCUMENTS

| | | | |
|---|---|---|---|
| EP | 0 737 603 | A1 | 10/1996 |
| EP | 1 249 794 | A1 | 10/2002 |

(Continued)

OTHER PUBLICATIONS

European Search Report for International Application No. PCT/EP2007/005723, mailing date Apr. 4, 2008.

*Primary Examiner* — Brent Swarthout
(74) *Attorney, Agent, or Firm* — Finnegan, Henderson, Farabow, Garrett & Dunner, L.L.P.

(57) ABSTRACT

The system allows a reliable and automatic detection of moving vehicles and advantageously also identification of the moving vehicles. A WPAN node device (advantageously a ZigBee node device) is installed on a vehicle to be detected when the vehicle is moving. Three WPAN node devices (advantageously three ZigBee node devices) are installed on the ground. One of the three WPAN node devices has a wide radio coverage area and acts as an "exciter" of the vehicle WPAN node device. Another one of the three WPAN node devices has a wide radio coverage area and acts as the "parent" of the vehicle WPAN node device. A further one of the three WPAN node devices has a narrow radio coverage area and acts as a "detector" of the vehicle WPAN node device. The three radio coverage areas are sized and located so that a moving vehicle to be detected enters the area of the "exciter" before entering the area of the "parent" and before entering the area of the "detector". After detection, the system provides for sending information to a fourth WPAN node device present in a user mobile telephone terminal.

21 Claims, 7 Drawing Sheets

(56) References Cited

U.S. PATENT DOCUMENTS

| | | | | |
|---|---|---|---|---|
| 7,969,951 | B2 * | 6/2011 | Liu et al. | 370/338 |
| 2002/0145542 | A1 | 10/2002 | Yamashita | |
| 2007/0040742 | A1 * | 2/2007 | Choi | 342/450 |
| 2007/0146163 | A1 * | 6/2007 | Annoni et al. | 340/932.2 |
| 2008/0112362 | A1 * | 5/2008 | Korus | 370/331 |
| 2010/0229216 | A1 * | 9/2010 | Koga | 726/3 |
| 2011/0294431 | A1 * | 12/2011 | Erdmann et al. | 455/41.2 |

FOREIGN PATENT DOCUMENTS

| | | | |
|---|---|---|---|
| EP | 1 876 570 | A1 | 1/2008 |
| WO | WO 95/14982 | A1 | 6/1995 |
| WO | WO 2005/064544 | A1 | 7/2005 |
| WO | WO 2007/059673 | A1 | 5/2007 |

* cited by examiner

VN
VN
VN

A1
A2
A3

A1
A2
A3

A1
A2
A3

METHOD AND SYSTEM FOR DETECTING A MOVING VEHICLE WITHIN A PREDETERMINED AREA

CROSS REFERENCE TO RELATED APPLICATION

This application is a national phase application based on PCT/EP2007/005723, filed Jun. 28, 2007.

FIELD OF THE INVENTION

The present invention relates to a system and method for detecting a moving vehicle within a predetermined area.

BACKGROUND OF THE INVENTION

In modern traffic control systems there is an increasing demand to have automatic systems able to accomplish various tasks like speed check, access check (in particular city access authorization policy check), parking payment, toll payment and so on.

Most of the checks on vehicles are done manually by public officers or, in case of speed check and access check, with the aid of one or more cameras connected to a computer system that through an appropriate algorithm automatically recognizes the vehicle plates and checks the rules (e.g. the speed limit, authorization policy, etc.). Even the computerized systems always require a manual inspection since the reliability of the recognizing algorithms is limited.

From EP737603 there is known a method and apparatus for identification of stolen vehicles; the identification procedure involves equipping each vehicle with an electronic plate operating without an electrical supply (i.e. passive); the electronic plate may have information written on to it in a form which can be read by electromagnetic waves from a reading device; when irradiated, the electronic plate produces a signal containing the recorded information which may include the serial number; the serial number information may be locked in the electronic plate, but there may be further information which can be modified; this may include the registration number of the vehicle and the name of the insurance company; the information may be read by a pistol-shaped reading device which interrogates the electronic plate for the stored information.

From U.S. Pat. No. 5,083,200 there is known a method for identifying objects in motion, in particular vehicles, and systems for its implementation; the method includes several steps whenever the object is moving inside a predetermined identification zone following a predetermined movement axis; the steps are periodically acquiring images of the object in a predetermined field of view, checking the nature of the image background in the field of view to obtain background reference information in the absence of the object, and processing the images acquired in combination with the background reference information in order to extract therefrom a silhouette of the object having crossed the field of view; this method and the corresponding systems may be used, in particular, with highway toll booths and for any other application demanding an identification of vehicles.

From U.S. Pat. No. 5,319,962 there is known a device for the identification of vehicle and equipment features; the device for the identification of vehicle features essentially comprises an electronic memory circuit which is arranged fixed to the vehicle and which can be read by an external apparatus which is to be connected to the vehicle; the memory is integrated into or onto a segment of the contact element support of a diagnosis socket, which segment is detachable from the latter; a part of a film-chip film circuit can very advantageously be used for this purpose, as is known from the technology and production of electronic credit cards and data cards; the electronic memory is initially written at the factory during the production of the vehicle, and then reflects the original equipment features of the vehicle. In the event of an installation or modification for the special equipment of the vehicle, the contents of the memory can be modified or updated electrically by the apparatus.

Automatic toll systems for highways are also known (called in Italy "Telepass") based on a radio receiver installed at a toll gate (mains powered) and radio transmitters installed on the vehicles (battery powered); by way of a dedicated radio communication protocol when a vehicle goes through the gate the vehicle identity is transferred from the transmitter to the receiver and a corresponding bill is sent to the vehicle's owner.

SUMMARY OF THE INVENTION

The Applicant has noticed that the prior art solutions for detection and identification systems suffer from different and several disadvantages:

- requires a photo or a video to be processed and the processing algorithm is complex and not particularly reliable,
- are not flexible in terms of exchanged information,
- are not flexible in terms of application,
- do not use standard communication protocols.

From the above considerations, it appears that there is a need for a system that allows a reliable and possibly fully automatic detection of moving vehicles.

The detection system should also be an identification system for moving vehicles or for their drivers or owners.

The detection system should have a wide range of applications including but not limited to vehicle access check as well as vehicle speed check and vehicle toll and/or parking payments.

The detection system should work reliably independent (within certain limits) on the speed of the vehicle to be detected.

Power consumption should be extremely reduced especially with regard to any device to be carried by the vehicles so that they can be battery powered and guarantee a long life without maintenance.

In order to reach the above described objectives, the Applicant has conceived to install on a moving vehicle to be detected a WPAN node device (advantageously a ZigBee node device) and to install, e.g. on the ground, three WPAN node devices (advantageously three ZigBee node devices) belonging to one WPAN network acting as an electronic gate.

WPAN [Wireless Personal Area Network] networks are known since some years; a PAN [Personal Area Network] network can be defined as a computer network for communicating among devices close to one person; a WPAN network is a PAN network using wireless short-range communication technologies such as Bluetooth; a communication technology which may be advantageously used for implementing a WPAN network is ZigBee.

One of the three fixed WPAN node devices has a wide radio coverage area and acts as an "exciter" of the vehicle WPAN node device, another one of the three fixed WPAN node devices has a wide radio coverage area and acts as the "parent" of the vehicle WPAN node device and a further one of the three fixed WPAN node devices has a narrow radio coverage area and acts as a "detector" of the vehicle WPAN node device; within this context, "exciter" means the fixed device that makes the moving device ready for detection and "detector" means the fixed device that carries out the detection of the moving device. The three radio coverage areas are sized and located so that a moving vehicle to be detected enters the area of the "exciter" before entering the area of the "parent" and before entering the area of the "detector".

According to the present, the "exciter" may contribute to the detection of the vehicle in two different ways: either it allows the vehicle WPAN node device to join the WPAN network timely before detection or it causes the vehicle WPAN node device to reduce its period of intermittent operation, i.e. to awaken more frequently, timely before detection.

Advantageously, the vehicle WPAN node device comprises a transceiver having an intermittent operation in order to save power and battery; anyway, this device may be adapted to keep a continuous operation and this is advantageously done during and some time before detection and/or to vary the period of the intermittent operation (or "awakening period") timely before detection. On the contrary, the fixed WPAN node devices shall typically comprise a respective transceiver having always a continuous operation.

According to the present invention, the detection of a moving vehicle corresponds at least to the reception of information, in particular vehicle identification information, by the narrow coverage fixed WPAN node device from the vehicle WPAN node device and/or to the reception of a vehicle detection signal by the narrow coverage second fixed WPAN node device from a vehicle sensor, in particular an optical or magnetic sensor.

Detection is carried out through a WPAN network communication; thanks to this kind of standard communication, the exchange of information is extremely flexible and this leads also to flexibility of application.

The present invention does not exclude that as a consequence of the detection of a moving vehicle a photograph is taken of the detected moving vehicle; in some applications, this may be required by law.

It is to be noted that a system according to the present invention may consists essentially in a number of WPAN node devices: a moving one and at least three fixed ones. The communication between the three fixed WPAN node devices is advantageously fully wireless type and may be direct or indirect through e.g. one or more WPAN node devices. This is extremely useful and advantageous for installation purposes.

Additionally, it is to be noted that the system according to the present invention may be connected to other telecommunication networks, either fixed or mobile, in order to exchange information for example information regarding to the detection of vehicles.

Finally, it is to be noted that the system according to the present invention may also be used for providing (traffic, parking or commercial) information to the vehicle and/or to a user within the vehicle, in particular its driver.

An advantageous way of providing information to a user is by WPAN communication between the vehicle WPAN node device and a WPAN node device connected to or integrated into a user mobile telephone terminal; an advantageous possibility is a mobile phone with a Subscriber Identification Module having an integrated ZigBee interface.

BRIEF DESCRIPTION OF THE DRAWINGS

The present invention will become more apparent from the following description to be considered in conjunction with the annexed drawing, wherein.

It is to be understood that the following description and the annexed drawing are not to be interpreted as limitations of the present invention but simply as exemplifications.

In the following two embodiments of the present invention will be described. In both embodiments the ZigBee technology is used for implementing the WPAN network, which is advantageous for the present invention.

DETAILED DESCRIPTION OF THE INVENTION

General of the Architecture

Figure 1:
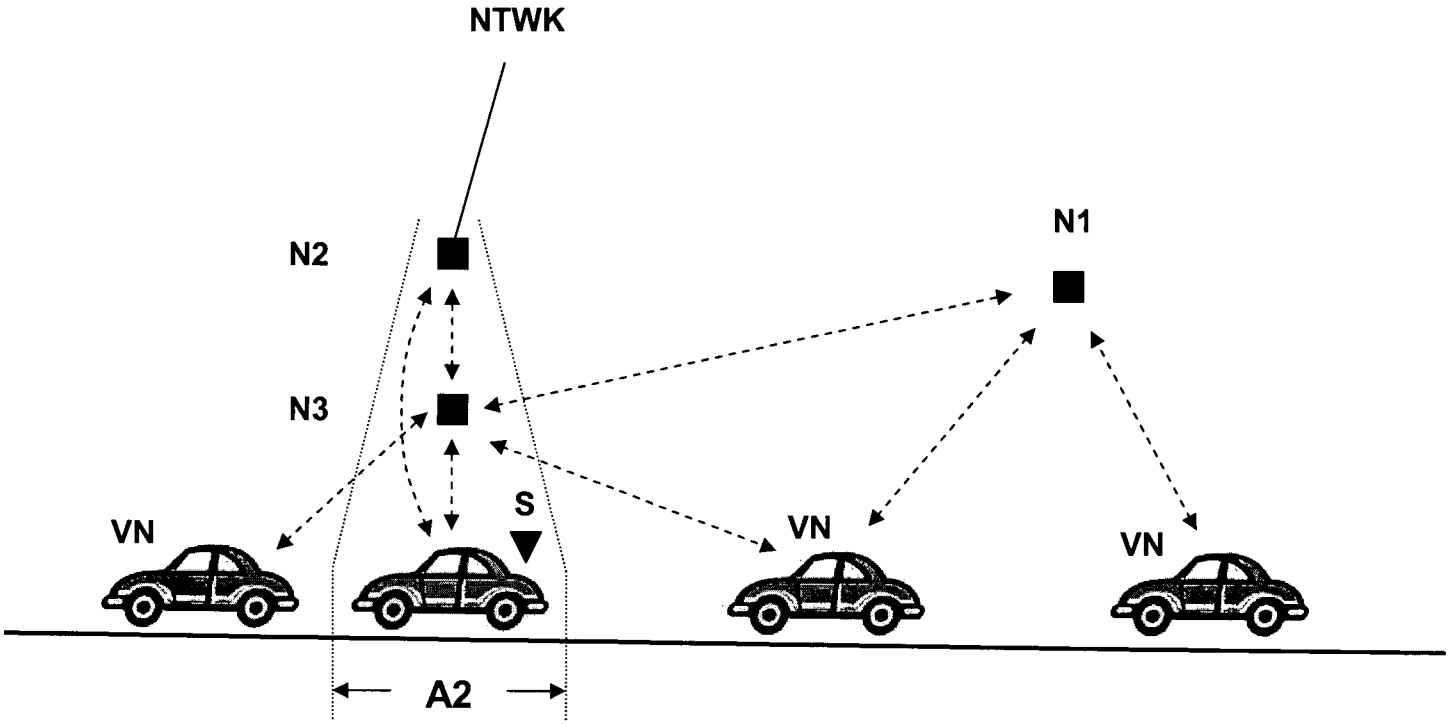
FIG. 1 shows schematically the architecture of a system according to the present invention.

The architecture of the system of FIG. 1 comprises a first fixed ZigBee node device N1 covering a first area A1 which is wide, a second fixed ZigBee node device covering a second area A2 which is narrow, a third fixed ZigBee node device N3 covering a third area A3 which is wide, and a vehicle ZigBee node device VN which is carried by a moving vehicle and therefore is also moving. Nodes N1, N2 and N3 belong to the same network and are bidirectionally connected together through a wired and/or wireless connection and direct and/or in direct connection; node N2 is also connected to an external telecommunication networks NTWK, either fixed or mobile; anyway, typically, the wireless connectivity provided by the ZigBee technology is used (see dashed lines with arrows between nodes N1 and N3 and between nodes N2 and N3).

Node VN is able to establish wireless ZigBee bidirectional communication with the nodes of the ZigBee network, in particular with nodes N1, N2 and N3 (see the dashed lines with arrows).

In FIG. 1, the same vehicle carrying the ZigBee node device is shown in three different positions along its movement (the movement of the vehicle in the figure is from right to left).

The system of FIG. 1 comprises also an optical sensor S located and arranged so to detect vehicles within area A2; sensor S is connected, in particular through a wired connection, to node N2 (this connection is not shown in the figure).

The vehicle carries a vehicle identification device which will be called in the following "ZigBee tag", referenced as ZTAG and which essentially consists of the vehicle ZigBee node device VN. The device ZTAG can be easily installed on the windshield of a vehicle or above the vehicle dashboard.

FIG. 2 shows schematically different possible arrangements of the coverage areas of the fixed WPAN node devices N1, N2 and N3 in the system of FIG. 1. It is to be noted these areas have a three-dimensional extension, but due to the fact that the vehicles considered by the present invention travel along existing roads, only one dimension is taken into account; in particular, FIG. 2 refers for simplicity to the case of a rectilinear road even if this is not a limitation of the present invention.

Figures 2A, 2B, 2C, 2D:
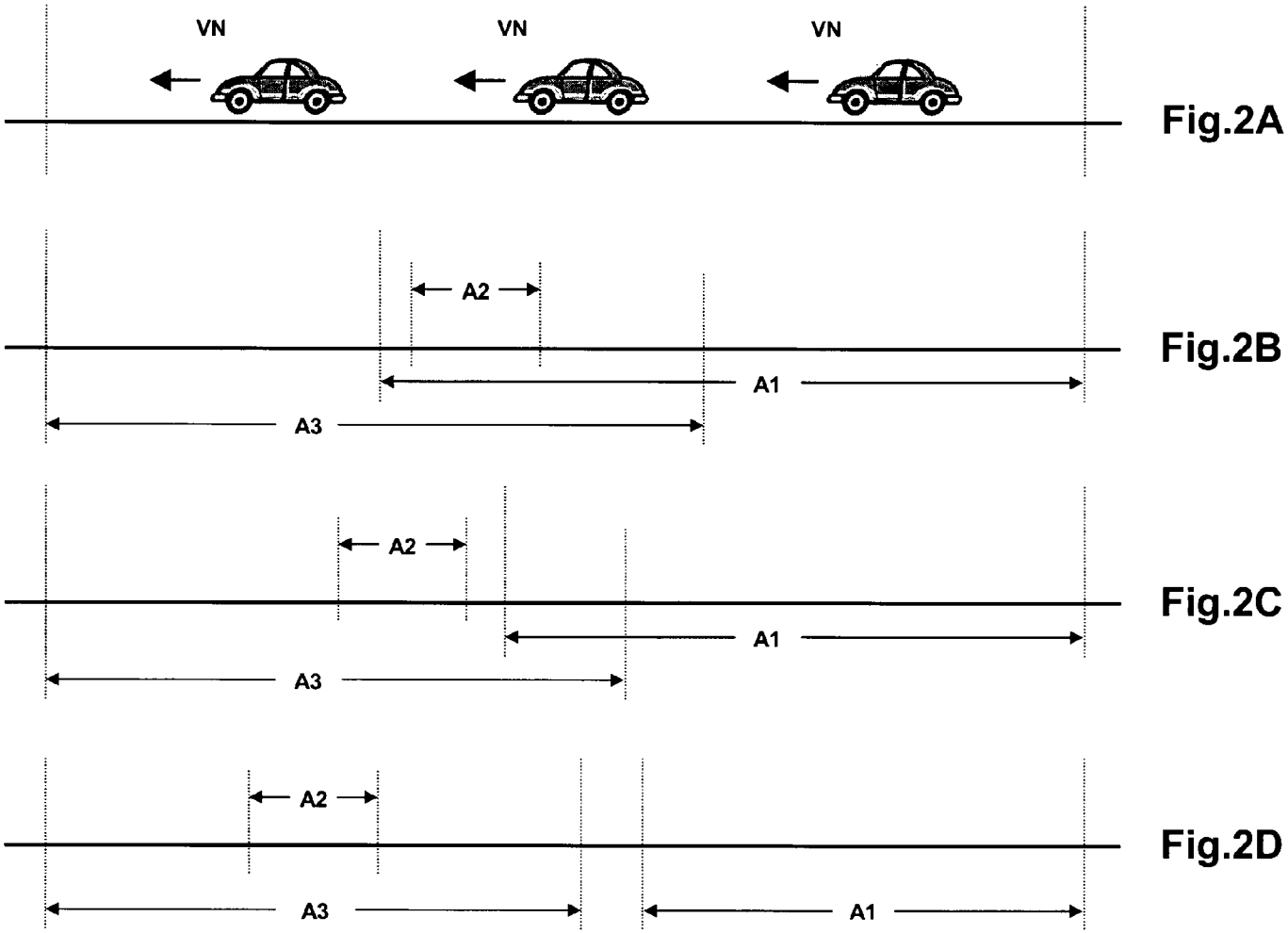
FIG. 2 shows schematically different possible arrangements of the coverage areas of the fixed WPAN node devices in the system of FIG. 1.

FIG. 2A shows a vehicle carrying a ZigBee node device VN and travelling along a rectilinear road from right to left; FIG. 2B and FIG. 2C and FIG. 2D shows areas A1, A2 and A3 with respect to this road; in all the three cases, the any vehicle travelling along this road from right to left enters first area A1 (which may be called the "excitation area"), then area A3 and finally area A2 (which may be called the "detection area").

Figure 3:
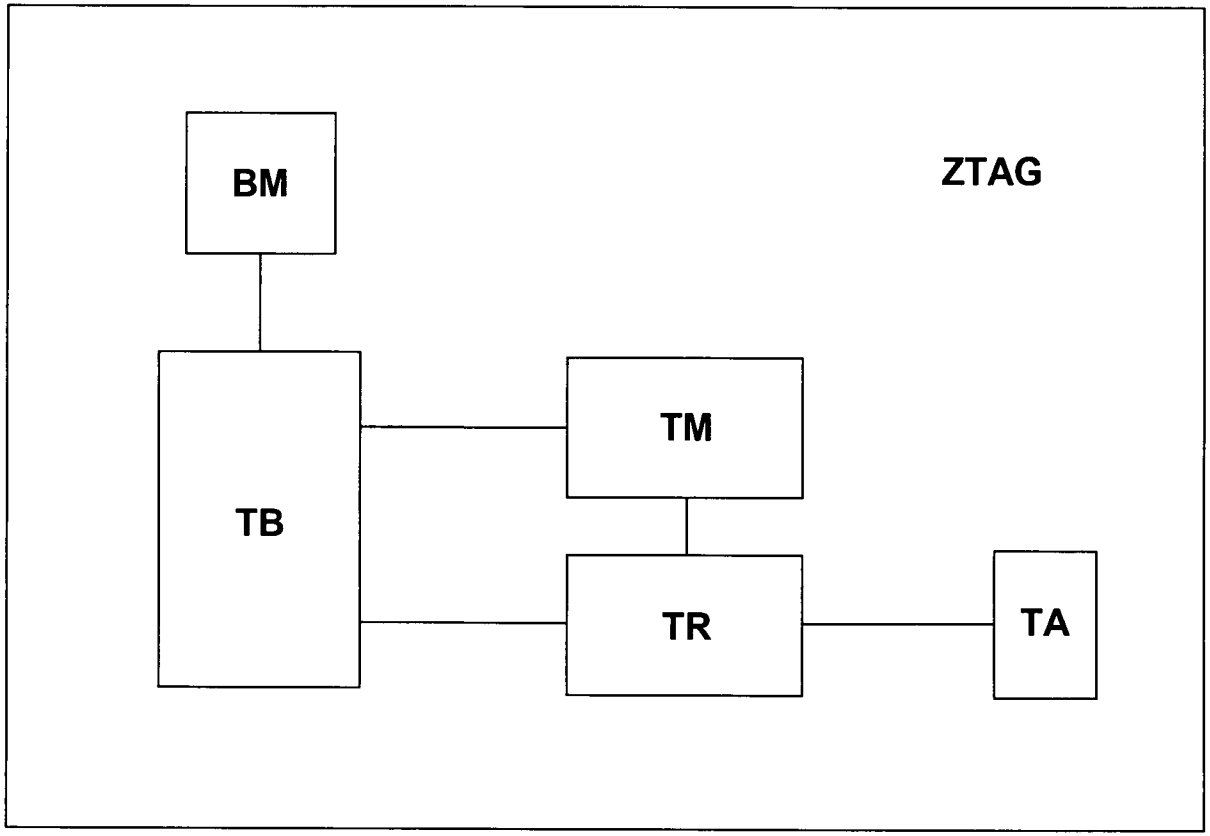
FIG. 3 shows schematically the architecture of a vehicle identification device according to the present invention.

With reference to FIG. 3, device ZTAG may be realized through a ZigBee radio chip TR, a ZigBee antenna TA and a microcontroller TM embedding e.g. Flash and RAM memories; Flash memory may store firmware and permanent data of the tag (e.g. of the vehicle and/or its owner) while RAM memory stores volatile data. The firmware running on microcontroller TM implements the ZigBee protocol stack as well as the tag applications; the previously listed hardware resources are normally sufficient for the firmware complexity, however, if needed, the device ZTAG can be enlarged with other components like memories and an additional microcontroller. The device ZTAG is power supplied by batteries TB. In normal applications non rechargeable batteries are used, however particular implementations of device ZTAG may be based on rechargeable batteries. In this case the device ZTAG includes also a battery management circuitry BM that allows recharge of the batteries from an external power source, including voltage regulation if necessary.

Device ZTAG cannot be externally reset or reprogrammed, thus avoiding tampering of its functionalities by the user; it can only be programmed during the assembly process; the same applies to permanent data stored in the ZTAG device.

In order to reduce power consumption, an application running on device ZTAG is configured to periodically let the device enter a "stand-by mode" or "sleep mode" and periodically let the device "awaken", i.e. exit this mode; this particularly applies to the ZigBee radio chip TR and its transceiver which is primarily responsible for power consumption; during stand-by phases the power consumption of device ZTAG, in particular of its radio transceiver, goes to few micro-Amperes thus saving batteries; in this way the device and the transceiver has an intermittent operation characterized by a "period of intermittency" or "stand-by period" or "awakening period".

Device ZTAG exits this mode periodically and looks for a ZigBee network to join, i.e. it carries out a "network polling". If it finds one, device application starts; otherwise, it goes back to stand-by mode. The network polling period and the stand-by phase duration must be set according to battery capacity, application requirements and expected device life time (without replacing or recharging batteries).

Device ZTAG is configured to be a ZigBee end-device or a ZigBee router; in the second case, the device is configured so not to allow association to it (the use of this feature will be explained later).

In order to provide different features and services, ZTAG device may be programmed with different firmware applications. According to the ZigBee technology, each firmware application uses a communication entity called endpoint. All ZTAG device endpoints as well as the applications on other devices wishing to communicate with ZTAG device use a unique ZigBee application profile. In the present embodiment of the invention each ZTAG device endpoint uses two different clusters, the first for input communication and the second for output communication. A device wishing to communicate with ZTAG device has to implement an application with an input cluster matching ZTAG device output cluster and the output cluster matching ZTAG device input cluster.

Figure 4:
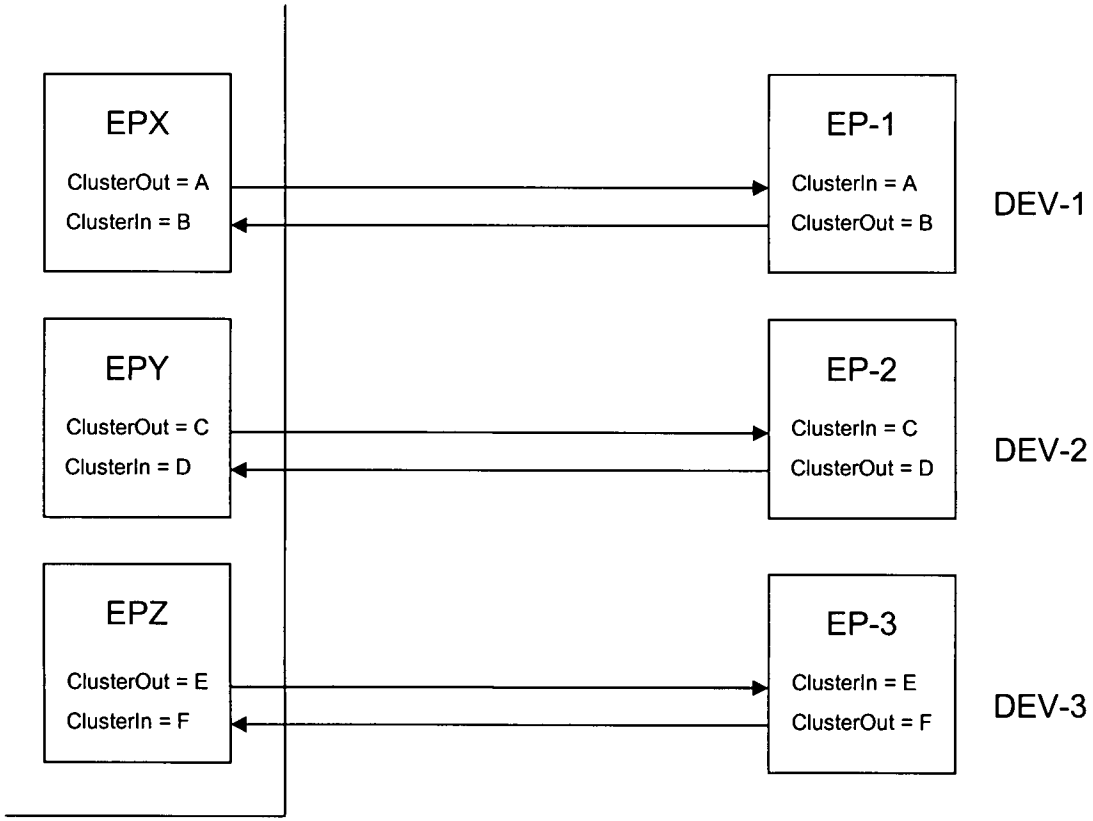
FIG. 4 shows schematically a possible application organization within the device of FIG. 3.

A typical device applications organization is shown in FIG. 4: ZTAG device provides three applications and correspondingly three endpoints EPX, EPY and EPZ; endpoint EPX uses ClusterOut=A and ClusterIn=B; endpoint EPY uses ClusterOut=C and ClusterIn=D; endpoint EPZ uses ClusterOut=E and ClusterIn=F. Three applications of three other devices DEV-1, DEV-2, DEV-3 whish to communicate with the three applications of ZTAG device; the endpoints of the three applications of the three external device are referenced in the figure as EP-1, EP-2, EP-3. In order to communicate through appropriate and dedicated channels, endpoint EP-1 of device DEV-1 uses ClusterIn=A and ClusterOut=B; endpoint EP-2 of device DEV-2 uses ClusterIn=C and ClusterOut=D; endpoint EP-3 of device DEV-3 uses ClusterIn=E and ClusterOut=F.

The main purpose of ZTAG device described above is the detection and/or identification of the vehicle in order to perform some kinds of checks on the moving vehicles e.g. access check on city entrance roads.

In many cities access regulation is based on a periodical check of gas emissions; only those vehicles whose emissions are below certain limits are allowed to circulate in the city area; according to the prior art, these vehicles are normally identified by a non-electronic tag attached to the windshield; this method does not permit any automatic control.

ZTAG device can replace e.g. such non-electronic tags.

For the above purpose, ZTAG device may store information related to the latest gas emission check; moreover, it can store other information related to the vehicle that can be used for improved access control policy (e.g. the size of the vehicle, the size of the engine, whether it is gasoline or diesel, etc.).

The access check is done by an electronic fixed device that embeds a ZigBee node device (typically including a microcontroller, a radio chip and an antenna); in the case of FIG. 1, such device is node N2 and may be called the "detector". The fixed node device, N2 in the example of FIG. 1, and the moving node device, VN in the example of FIG. 1, are designed so that become part of the same ZigBee network and thus communicate.

The same fixed device, N2 in the example of FIG. 1, may be also able to communicate over a public telecommunication network (fixed and/or mobile) and therefore may behave as a gateway between the ZigBee network and the telecommunication network; this may allow to transmit e.g. transits data to dedicated servers and to receive e.g. reconfiguration information (e.g. new access policies) of the gateway itself if needed.

Due to law regulations, the "detector" node may be provided or associated to a camera system able to take pictures of e.g. violating vehicles; in fact, these pictures may be used as legal evidence when fining owners of the violating vehicles.

In the embodiment of FIG. 1, the "detector" node N2 communicate with node VN on the vehicle when the vehicle transits under it and, if needed, a picture is taken; the need to take the picture derives from the communication between nodes N2 and VN; more specifically, node N2 receives from node VN on the vehicle information that are used in order to decide whether to take a picture or not.

This is achieved installing on node N2 a directive antenna that covers a narrow (preferably very narrow) area, A2 in the example of FIGS. 1 and 2, under the node itself. The radio area coverage may be advantageously dimensioned according to a typical vehicle size (e.g. from 1 to 5 meters, typically 2 or 3 meters).

The communication with VN node shall be established immediately when the vehicle enters the radio coverage A2 of node N2. This can be achieved for example by installing at the road level a fixed sensor, S in the example of FIG. 1, able to detect a transiting vehicle (e.g. a photoelectric sensor or a magnetic sensor). Sensor S is connected to node N2 and when the vehicle transit detection occurs, a vehicle detection signal is sent from sensor S to node N2, is received by node N2 and node N2 try to establish a communication with node VN on the vehicle.

Since the radio coverage area A2 is very narrow the transit time spent under node N2 by a vehicle is very short. Let's call x the length (expressed in meters) of the radio coverage of node N2 and v the speed of the vehicle in km/h. The time t spent under node N2 (expressed in ms) is obtained through the following formula:

$$t=(x/v)*3,6$$

For instance, in a typical situation, with x=3 m and v=70 km/h, t is equal to 154 ms.

This would require the vehicle detection device comprising the vehicle WPAN node device to frequently poll for a WPAN network, i.e. for a fixed WPAN node device; therefore, the "period of intermittency" would be very short and this would lead to a high power consumption and a short life of the batteries of the vehicle detection device. Moreover, such short transit time would not permit the moving vehicle ZigBee node device VN to successfully join the "detector" fixed ZigBee node device N2 and communicate with it (typical ZigBee association time is around 500 ms).

Due to these reasons, the present invention teaches to use another fixed WPAN (in the example of FIG. 1, ZigBee) node device that acts as an "exciter"; in the example of FIG. 1, the "exciter" fixed node device is the ZigBee node device N1. Node device N1 is installed upstream node device N2 with respect to the direction of movement of the moving vehicles to be detected; the direction of movement is typically a road, e.g. a city road.

Node device N1 has wide radio coverage area A1 (e.g. up to 80 m) and may be provided with omni-directional antenna.

The role of "exciter" node device N1 is to make the moving node device VN ready for detection so that the "detector" node device N2 would succeed to detect and identify the moving node device VN.

When ZTAG device comprising node device VN polls for a ZigBee network and finds an "exciter" node device, it prepares to communicate with the ZigBee network and accomplish all the needed operations. Thus the "period of intermittency" is must be calculated considering the time spent by a vehicle under the "exciter" node device and an application time to that includes the polling time and may (in some of the embodiments of the present invention) also include the time required for association to and dissociation from the ZigBee network. The formula is the following:

$$ts=(y/v)*3,6-ta$$

In the example of FIG. 1, in order to accomplish the needed communication all the node devices (the "detector", the "exciter" and the "tag") are connected to the same ZigBee network.

The method according to the present invention serves for detecting a moving vehicle within a predetermined area by means of at least a first fixed WPAN node device, i.e. ZigBee node N1 in the example of FIG. 1, and a second fixed WPAN node device, i.e. ZigBee node N2 in the example of FIG. 1, and a third fixed WPAN node device, i.e. ZigBee node N3 in the example of FIG. 1; the moving vehicle carries a vehicle WPAN node device, i.e. ZigBee node VN in the example of FIG. 1; nodes N1 and N2 and N3 belong to one and the same WPAN network and node VN is designed to join this network; node N1 covers a first wide area, A1 in the example of FIG. 1 and FIG. 2, node N2 covers a second narrow (or very narrow) area, A2 in the example of FIG. 1 and FIG. 2, corresponding to the predetermined area where detection is desired, node N3 covers a third wide area, A3 in the example of FIG. 1 and FIG. 2; said first and second and third areas are sized and located so that a vehicle to be detected enters the area A1 of the "exciter" N1 before entering area A3 of node N3 and before entering the area A2 of the "detector" N2.

With reference to FIG. 1, the method comprises in general the steps of:

A) when the vehicle enters area A1 or area A3 (depending on the instant when it exits stand-by mode, i.e. when it awakens) the vehicle node VN discovers the ZigBee network through node N1 or node N3 and prepares for joining the ZigBee network through node N3, B) afterwards, when the vehicle enters area A3 the vehicle node VN joins the ZigBee network through node N3, C) afterwards, when the vehicle enters area A2 the vehicle node VN transmits information to node N2, D) afterwards, the vehicle node VN leaves the ZigBee network through node N3;

The detection of the moving vehicle within said predetermined area, i.e. area A2, may correspond simply to the reception of said information by node N2 (step C).

Additionally, the information transmitted at step C may comprise vehicle identification information and/or other vehicle information (including e.g. the identity of its owner); in this case, the detection of the moving vehicle within said predetermined area, i.e. area A2, may correspond additionally to the reception of said vehicle information by node N2 so it is a detection with electronic automatic identification.

The vehicle node VN typically uses a transceiver having an intermittent operation for communicating with other ZigBee node devices of the ZigBee network.

If a sensor, S in the example of FIG. 1, is provided for detecting vehicles within area A2 and if this sensor is connected to node N2 in order to transmit vehicle detection signals to it, the detection of the moving vehicle within said predetermined area, i.e. area A2, may correspond additionally to the reception of a vehicle detection signal by node N2 from the sensor.

This sensor may be used to determine the exact instant for taking a photograph to the vehicle.

Alternatively or additionally, sensor S may be used to signal to node N2 the best time for transmitting over the air e.g. a "broadcast request" asking for "vehicle data" to node VN.

In the system of FIG. 1, the third fixed ZigBee node device N3 that acts also as a "hop" node in the sense that communication between node N1 and node N2 is wireless type and passes through node N3.

It is to be noted that, according to the arrangement of FIG. 1 (which may be a typical situation when a system according to the present invention is installed in a real environment), the narrow coverage area of node N2 does not cover node N1 and even the wide coverage area of node N1 does not cover node N2; therefore, no direct radio communication would be possible between nodes N1 and N2.

In order to realize a radio communication between nodes N1 and N2 node N3 is used; node N3 is located at a location covered by both node N1 and node N2 for example below node N2; node N3 has preferably a wide radio coverage area through e.g. an omni-directional antenna. If necessary, more than one node may be used for allowing radio communication between the "exciter" node and the "detector" node; this may depend on the geographical situation where the system according to the present invention is installed.

In FIG. 1, bidirectional Wireless communication between the various nodes of the ZigBee network are represented by dashed lines with arrows.

The system architecture of FIG. 1 may be used for implementing two different embodiments of the present invention.

First Embodiment

Figure 5:
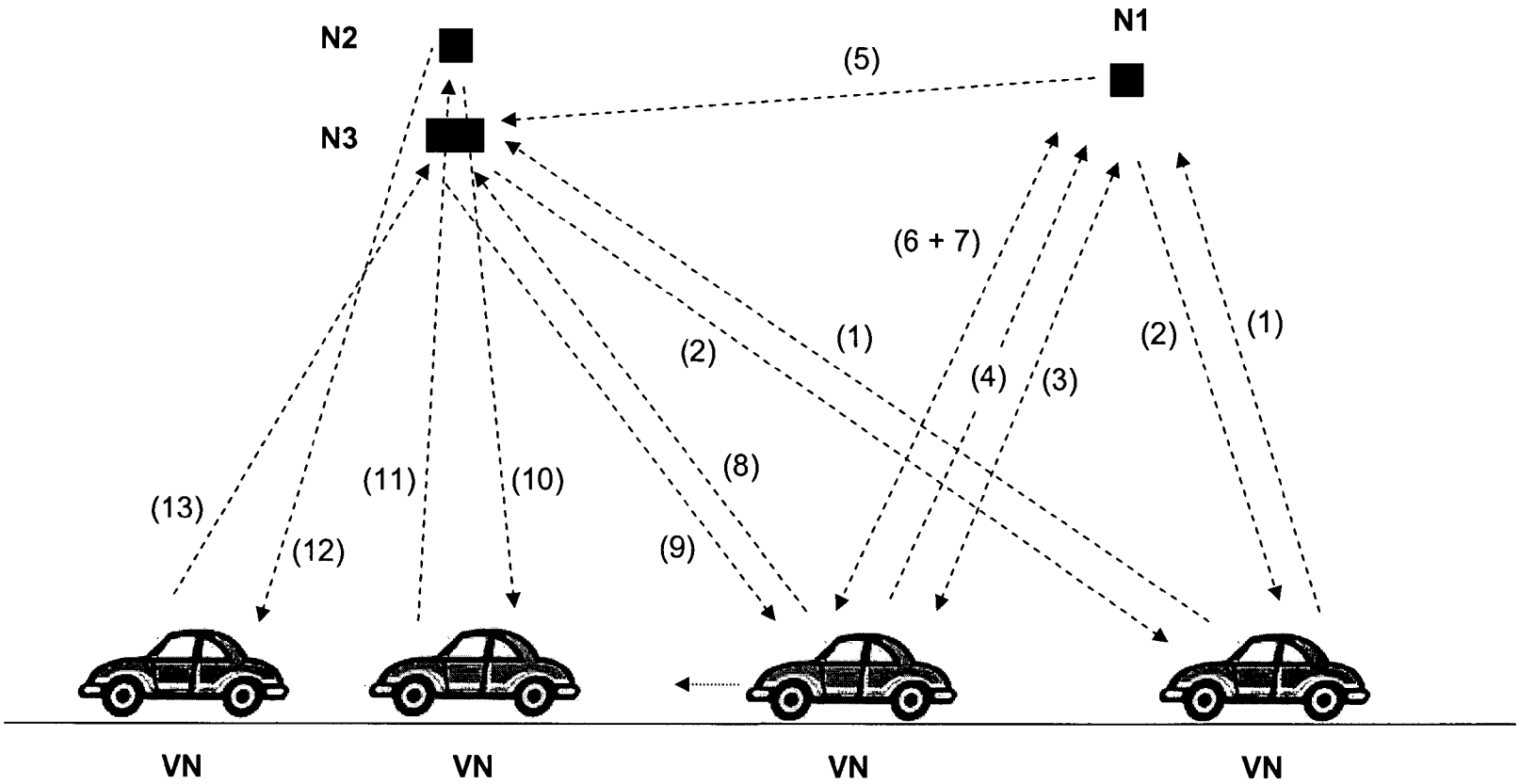
FIG. 5 shows schematically a flow of communication within the system of FIG. 1 according to a first embodiment of the present invention.

FIG. 5 shows schematically a flow of communication within the system of FIG. 1 according to a first embodiment of the present invention, In FIG. 5, the same vehicle carrying the ZigBee node device is shown in four different positions along its movement (the movement of the vehicle in the figure is from right to left).

According to this first embodiment, vehicle node VN prepares to join the ZigBee network through node N3 by "pre-joining" the network through the "exciter" node N1. The "pre-join" requires association to the network and is a lengthy process (and it is done timely before detection) while the "re-join" does not require association and therefore is quick.

The "exciter" node, i.e. node N1, is configured as a ZigBee coordinator while the "detector" node, i.e. node N2, and the "hop" node, node N3, are configured as router. The "tag" node, i.e. node VN on the moving vehicle, is also configured as a router. The gate WPAN network uses a predetermined radio channel ("gate radio channel") to allow the ZigBee "tag" node to perform a ZigBee network scan on a single channel, thus saving time. Since the network capacity is limited it's important that the "tag" node leaves the network after having communicated with the "detector" node in order to free network resources for other "tag" nodes on other moving vehicles.

The resulting application flow may be as follows (reference to numerical references in FIG. 5)—in the following ZigBee terminology will be used:

1: The "tag" node periodically exits stand-by mode and looks for a network; this is done sending a "beacon request" on the gate radio channel; if there's no reply within e.g. 15 ms the "tag" node assumes that no network is present and goes back to stand-by mode.

2: According to the "tag" node VN position in the gate zone both the "hop" node N3 and the "exciter" N1 or one of them sends a "beacon reply" to the "tag" node VN.

3: The "tag" node, according to known ZigBee mechanisms chooses a device to join with and performs the association procedure.

4: The "tag" node broadcasts a ZigBee end_device_announce message to communicate its physical (MAC) address; if the "tag" node associates with the "hop" node the flow continues with the following step 10, otherwise it continues with the step 5 below.

5: The "exciter" node sends a "direct_join" request message to the "hop" node N3 with the tag MAC address; this allows the "hop" node that is a router to become "parent" of the "tag" node.

6: The "exciter" node sends a "leave request" message to the "tag" node VN to force it leaving the association with the "exciter" node.

7: The "tag" node VN performs a "leave" operation.

8: After leaving the network the "tag" node starts the "orphan" procedure to look for its "parent" in the ZigBee network.

9: Thanks to the "direct_join" request the "hop" node N3 behaves as the tag parent and responds to the "orphan request"; the "tag" node is already associated to the network and quickly joins the network (without association) through the "hop" node N3.

10: The vehicle transit near the transit sensor S and this is signalled to the "detector" node N2; the "detector" node thus sends a "broadcast request" asking for tag data; the "broadcast request" is sent with "radius" equal to 1; this means that there is no re-broadcast of the message by the "hop" node (or any "tag" node); only the "tag" node within the coverage area of the "detector" node receives this message.

11: The "tag" node VN replies to this message with the requested data.

12: The "detector" node sends back an acknowledge to the "tag" node with relevant information concerning access authorization.

13: After this reply the "tag" node sends a "leave request" to the "hop" node to leave the network.

After step 11 the "detector" node N2 is able to perform, if requested by the service, a check on vehicle transit, e.g. for vehicle transit authorization. If the vehicle is authorized to transit nothing is done, otherwise the "detector" node takes a picture of the vehicle plate.

According to this first embodiment, it is advantageous that node VN keeps its transceiver continuously operative from the time of association to node N1 till the time of dissociation from any node of the ZigBee network, in particular node N3.

Second Embodiment

Figure 6:
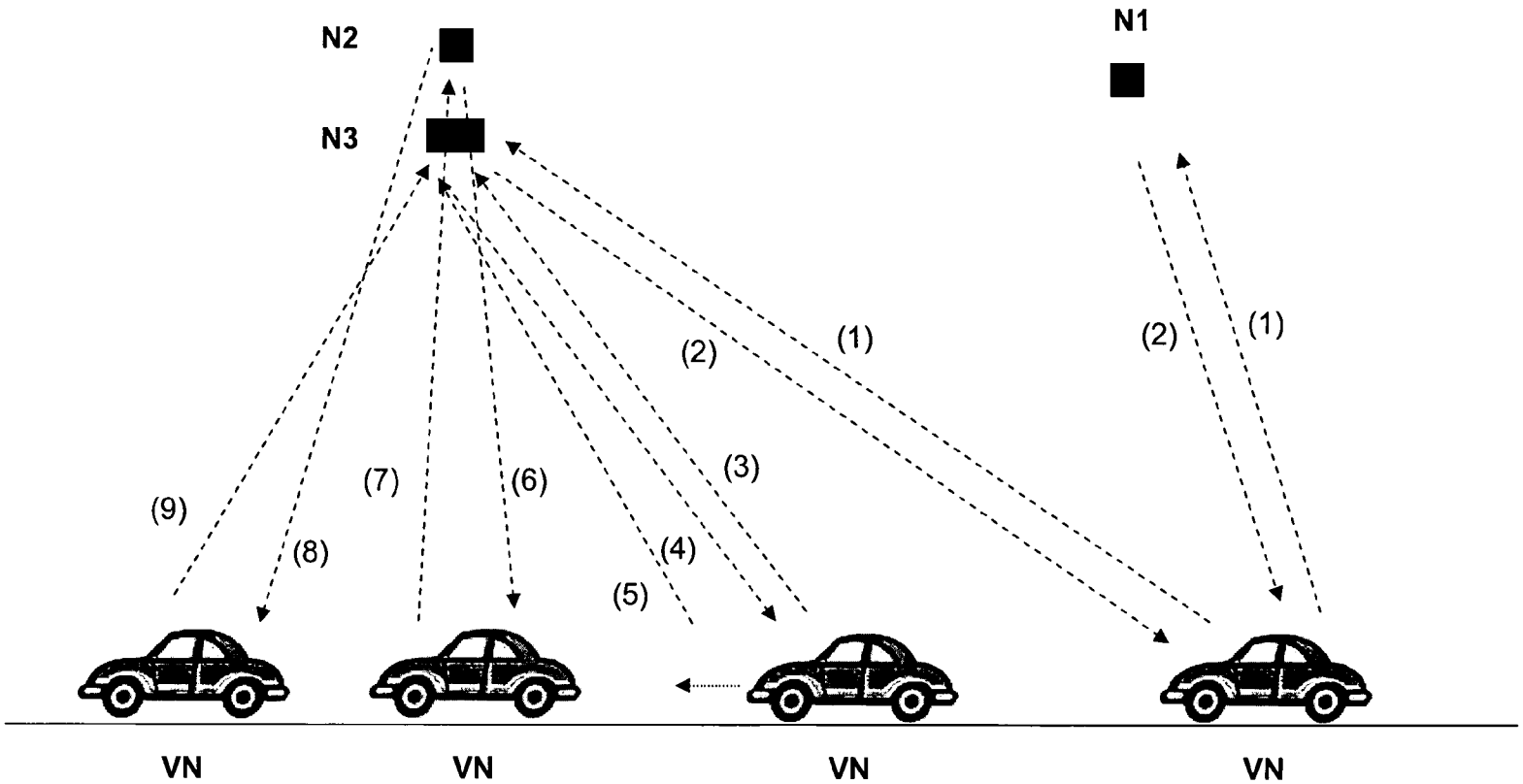
FIG. 6 shows schematically a flow of communication within the system of FIG. 1 according to a second embodiment of the present invention.

FIG. 6 shows schematically a flow of communication within the system of FIG. 1 according to a second embodiment of the present invention, In FIG. 6, the same vehicle carrying the ZigBee node device is shown in four different positions along its movement (the movement of the vehicle in the figure is from right to left).

According to this second embodiment, vehicle node VN prepares to join the ZigBee network by reducing the "intermittency period" as soon as it discovers the ZigBee network through the reply by the "exciter" node N1. In this case, the "join" operation to the ZigBee network through node N3 requires association to the network (and is a lengthy process) but it is done timely before detection as the vehicle node VN repeats association attempts very frequently. It is to be noted that, if the vehicle node N3 awakens when it is already within the coverage area A3 of node N3, it is not necessary to reduce "intermittency period" but an association attempt may be carried out immediately. According to this second embodiment N1 may be configured as a router and N3 as a coordinator.

According to this second embodiment, even if the "exciter" node N1 replies to a "beacon request" by the vehicle node VN, the "exciter" node N1 doesn't allow association to it. Its role is simply to prepare the "tag" for detection and change its "intermittency period". After the "tag" recognizes the presence of an "exciter", thanks to its beacon reply, it assumes that the it's approaching the "hop" node N3 and the "detector" node N2 (i.e. the detection gate) and thus reduces its period in order to quickly associate with the "hop" node. The resulting communication flow may be as follows (reference to numerical references in FIG. 6):

1: The "tag" node VN periodically exits stand-by mode and look for a network; this is done sending a "beacon request" on the gate radio channel; if there's no reply within e.g. 15 ms the "tag" node assumes that no network is present and goes back to stand-by mode.

2: According to the "tag" node position in the gate zone both the "hop" node N3 and the "exciter" node N1 or one of them sends a "beacon reply" to the "tag" node. The association flag of the "exciter" beacon reply is set to FALSE, in order to deny association to it. If the "tag" node only detects the "exciter" beacon reply flow goes to step 3 below, otherwise it continues with the following step 5.

3: The "tag" node VN starts sending periodical "beacon request", with a high repetition rate.

4: When the "tag" node VN is close enough to the "hop" node this sends a "beacon reply" with the association flag set to TRUE.

5: On reception of the "hop" beacon reply the "tag" node associates to the "hop" node.

6: The vehicle transit near the transit sensor S and this is signalled to the "detector" node N2; the "detector" node thus sends a "broadcast request" asking for tag data; the "broadcast request" is sent with "radius" equal to 1; this means that there is no re-broadcast of the message by the "hop" node N3 (or any "tag" node); only the "tag" node within the coverage area of the "detector" node receives this message.

7: The "tag" node VN replies to this message with the requested data.

8: The "detector" node N2 sends back an acknowledge to the "tag" node with relevant information concerning access authorization.

9: After this reply the "tag" node VN sends a "leave request" to the "hop" node to leave the network and reset its "intermittency period" to its normal value.

According to this second embodiment, it is advantageous that node VN keeps its transceiver continuously operative from the time of association to node N3 till the time of dissociation from any node of the ZigBee network, in particular node N3.

Alternatives and Extensions of the Invention

The same application flows described above may be used in all situations in which a ZigBee device carried by a moving vehicle transits near a fixed ZigBee device wishing to communicate with it, even for commercial applications.

Such additional communication may advantageously take place when the vehicle transits within the detection area according to the present invention. With reference to the figures, such information may be transmitted by node N2, i.e. the "detector", to node VN, i.e. the "tag", at the time detection (during step C); the information may relate to traffic, parking or any kind of information; the information may be directed to the vehicle or to the user, in particular its driver. Alternatively, such transmission may be carried out by another node of the WPAN network, for example node N3, connected to the "detector" node N2 and able to or dedicated to this function; in this case, such transmission may be carried out during the time when the "tag" node NV is associated to the WPAN network.

Moreover, it is possible to enlarge the "excitation area" by employing more than one "exciter" node (located on the same road or on different roads); in this case, one of the "exciter" nodes may be configured as a "coordinator" while the others as "routers".

The application described above may be improved by adding a communication protocol between the "tag" node and a user mobile telephone terminal (for example a mobile phone) to provide the user with access to information sent e.g. by the "detector" node. For this purpose the user terminal may be equipped with a ZigBee interface with an application organized as the one depicted by DEV-2 device of FIG. 3 and the "tag" node may be equipped with an application as the one depicted by EPY in FIG. 4; ZigBee interface may be advantageously integrated in a Subscriber Identification Module fit within the mobile phone terminal. The tag and the user terminal may thus communicate and all relevant information may be provided to the user by means, for instance, of a text message.

Relevant information may be provided e.g. by the "detector" node N2 (which is a gateway node in the above described embodiment) e.g. in step 12 of FIG. 5. Beside the access authorization policy other information may be provided by the "detector" node to the "tag" node such as city traffic information, parking location and so on (for example commercial information in general).

In order to allow this, a ZigBee network may be established between the tag and the user terminal; as there must be a coordinator in order to form a ZigBee network, and as the "tag" node is already configured as a router, the user terminal Zigbee interface may be configured as coordinator.

Moreover, re-joining the gate network (nodes N1, N2 and N3) by the "tag" node VN should be avoided. In fact, in most of the cases, after the "tag" node leaves the gate network, the "tag" node is still within the radio coverage area of the "hop" node N3 and eventually within the coverage area of the "exciter" node N1 too; so in principle the "tag" node might associate to either of these two nodes and join the gate network. In order to avoid this, the gate network identifier (defined in the ZigBee technology as the "PAN ID" [Personal Area Network identifier]) is stored in the "tag" node. When the "tag" node scans the radio range to look for a network right after its transit through the gate, it tries to join a ZigBee network with a PAN ID different from that of the gate network.

Figure 7:
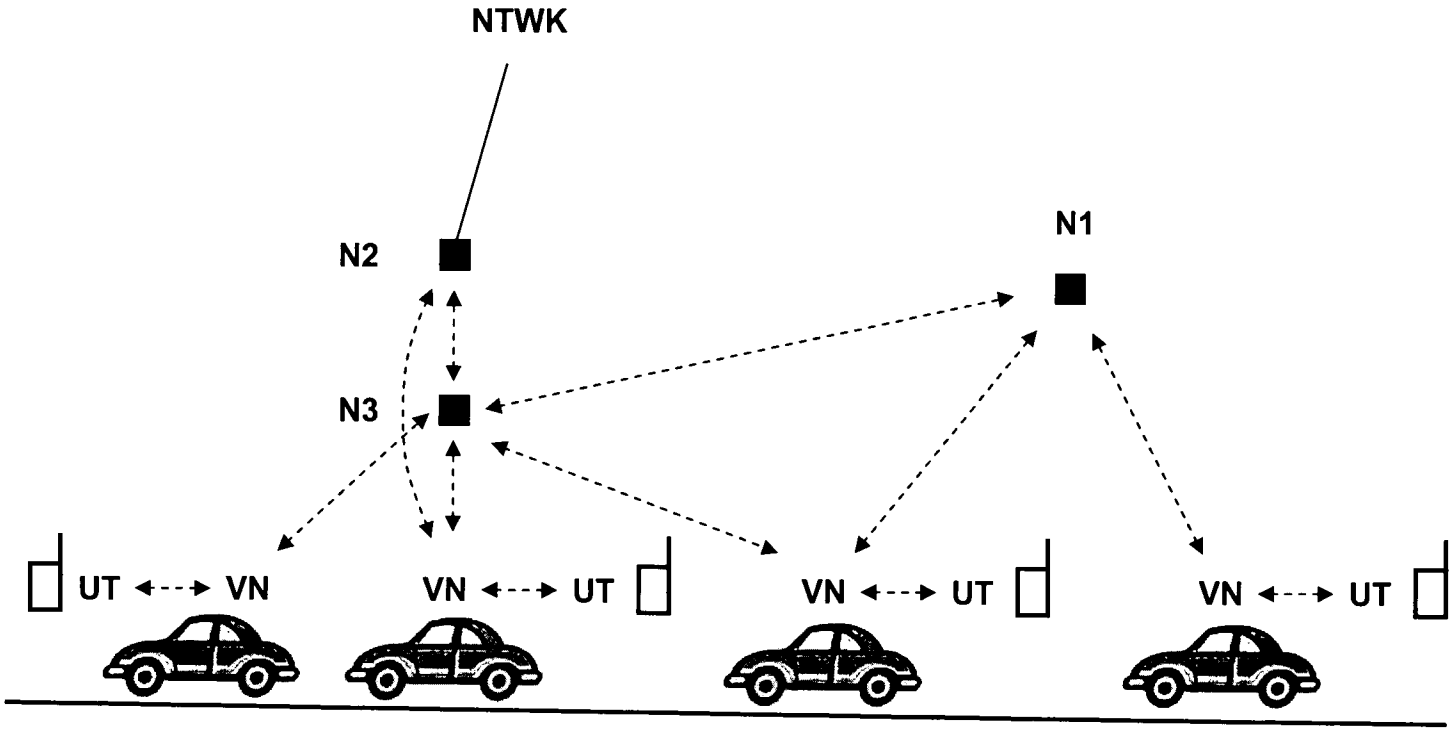
FIG. 7 shows schematically the architecture of an extension of the system of FIG. 1 with interaction with a user mobile terminal.

FIG. 7 shows schematically the architecture of an extension of the system of FIG. 1 wherein a user mobile terminal UT is present within the vehicle and is connected to the vehicle "tag" node VN.

The communication flow (relating only to the added device) might be as follows (step numbers start from 14 in order not to be confused with the steps described above):

14: The "tag" node VN periodically exits stand-by mode and look for a ZigBee network; this is done sending a "beacon request"; if there is no reply within e.g. 15 ms the "tag" node assumes that no network is present and goes back to stand-by mode.

15: According to the "tag" node position either of the gate ZigBee nodes (i.e. "hop" node and/or "exciter" node) and the ZigBee node of the user mobile terminal UT responds to the "beacon request".

16: The "tag" node compares the PAN ID of the beacon replies with the stored gate PAN ID, chooses the user terminal PAN ID, and according to known ZigBee mechanisms performs an association procedure.

17: A logical channel is created between endpoint EPY on the "tag" node and EP-2 endpoint on the user terminal node, i.e. node device DEV-2; this is done using known ZigBee mechanisms such "Match_description" functions or "bind" procedures.

18: The "tag" node VN automatically sends relevant information to the ZigBee node of the user mobile terminal UT.

19: The "tag" node leaves the ZigBee network of the user mobile terminal UT. It is to be noted that the steps relating to the communication between the "tag" and the "user terminal" may be arranged in different way and thus partially overlap (in time) with the steps relating to the communication between the "tag" and the nodes of the "gate" WPAN network (i.e. nodes N1, N2 and N3 in the figures) according to the first or second embodiment of the present invention; therefore, they might be integrated into a single sequence of steps covering both kinds of communication.

After the two sets of steps and the single integrated set of steps, the "tag" node may restarts the procedure. In order to avoid that the "tag" node immediately rejoins the "gate" WPAN network, it is possible to set a wait time after leaving the user terminal network and/or the gate network. During the wait time the "tag" node does not look for any network; the wait time may be set so to allow the vehicle to leave the gate zone and therefore next WPAN network found will not be the already-joined gate WPAN network.

The invention claimed is:

1. A method for detecting a moving vehicle within a predetermined area by means of at least a first wireless personal area network node device and a second wireless personal area network node device and a third wireless personal area network node device, wherein said moving vehicle carries a vehicle wireless personal area network node device, wherein said first wireless personal area network node device and said second wireless personal area network node device and said third wireless personal area network node device belong to one wireless personal area network, wherein said first wireless personal area network node device covers a first area and said second wireless personal area network node device covers a second area corresponding to said predetermined area and said third wireless personal area network node device covers a third area, said first and second and third areas being sized and located so that a vehicle to be detected enters said first area before entering said third area and before entering said second area, comprising the steps of:

A) when entering said first area with said vehicle, said vehicle wireless personal area network node device discovers said wireless personal area network through said first wireless personal area network node device and prepares for joining said wireless personal area network through said third wireless personal area network node device, wherein said preparing comprises reducing a stand-by period of said vehicle wireless personal area network node device;

B) when entering said third area with said vehicle, said vehicle wireless personal area network node device joins said wireless personal area network through said third wireless personal area network node device;

C) when entering said second area with said vehicle, said vehicle wireless personal area network node device transmits information to said second wireless personal area network node device; and D) when leaving said wireless personal area network, said vehicle wireless personal area network node device leaves through said third wireless personal area network node device;

wherein a transceiver of said vehicle wireless personal area network node device is continuously operative from starting step B until ending step D, whereby the detection of said moving vehicle within said predetermined area corresponds at least to the reception of said information by said second wireless personal area network node device.

2. The method according to claim 1, wherein said information transmitted at step C comprises vehicle identification information.

3. The method according to claim 1, wherein said wireless personal area network is a ZigBee network.

4. The method according to claim 1, wherein said preparing for joining by said vehicle wireless personal area network node device at step A comprises joining and afterwards leaving said wireless personal area network through said first wireless personal area network node device, and wherein said joining by said vehicle wireless personal area network node device at step B comprises joining again said wireless personal area network through said third wireless personal area network node device.

5. The method according to claim 4, wherein after step A and before step B, said first wireless personal area network node device transmits to said third wireless personal area network node device information relating to the identity of said vehicle wireless personal area network node device.

6. The method according to claim 1, wherein said vehicle wireless personal area network node device periodically exits a stand-by mode and looks for a network through a transceiver having an intermittent operation.

7. The method according to claim 6, wherein a transceiver of said vehicle wireless personal area network node device is continuously operative from starting step A until ending step D.

8. The method according to claim 1, wherein at least one sensor is provided for detecting vehicles within said second area and is connected to said second wireless personal area network node device in order to transmit vehicle detection signals thereto, whereby the detection of said moving vehicle within said predetermined area corresponds additionally to the reception of a vehicle detection signal by said second wireless personal area network node device from said sensor.

9. The method according to claim 1, wherein, during the time between step C and step D, a wireless personal area network node device of said wireless personal area network transmits to said vehicle wireless personal area network node device information to be used by the vehicle or to be provided to a user.

10. The method according to claim 9, wherein said wireless personal area network node device is said second wireless personal area network node device that transmits said information through said third wireless personal area network node device.

11. The method according to claim 1, wherein said vehicle wireless personal area network node device, after leaving said wireless personal area network, associates with a user mobile telephone terminal.

12. The method according to claim 9, wherein said information is forwarded to a user mobile telephone terminal.

13. The method according to claim 12, wherein said mobile telephone terminal comprises a wireless personal area network node device and receives said information from said vehicle wireless personal area network node device through a wireless personal area network connection.

14. A system for detecting moving vehicles within a predetermined area comprising:

a first wireless personal area network node device capable of covering a first area and belonging to a wireless personal area network;

a second wireless personal area network node device capable of covering a second area belonging to said wireless personal area network, said second area corresponding to said predetermined area;

a third wireless personal area network node device capable of covering a second area belonging to said wireless personal area network; and a vehicle wireless personal area network node device capable of being carried by a vehicle, said first and second and third areas being sized and located so that a vehicle to be detected enters said first area before entering said third area and before entering said second area, and said wireless personal area network node devices capable of being arranged so that:

when said vehicle enters said first area, said vehicle wireless personal area network node device discovers said wireless personal area network through said first wireless personal area network node device and prepares for joining said wireless personal area network through said third wireless personal area node device, wherein said preparing comprises reducing a stand-by period of said vehicle wireless personal area network node device;

when said vehicle enters said third area, said vehicle wireless personal area network node device joins said wireless personal area network through said third wireless personal area network node device, when said vehicle enters said second area, said vehicle wireless personal area network node device transmits information to said second wireless personal area network node device, and when leaving said wireless personal area network, said vehicle wireless personal area network node device leaves through said third wireless personal area network node device, wherein a transceiver of said vehicle wireless personal area network node device is continuously operative from entering said third area to leaving said wireless personal area network, whereby the detection of said moving vehicle within said predetermined area corresponds at least to the reception of said information by said second wireless personal area network node device.

15. The system according to claim 14, wherein said first and second areas are sized and located so that a vehicle to be detected enters said first area before entering said second area.

16. The system according to claim 14, wherein said second and third areas are sized and located so that a vehicle to be detected exits said second area before exiting said third area.

17. The system according to claim 14, wherein said wireless personal area network node devices are ZigBee node devices.

18. The system according to claim 14, further comprising at least one sensor capable of being located and arranged to detect vehicles within said second area and connected to said second wireless personal area network node device in order to transmit vehicle detection signals thereto.

19. The system according to claim 14, wherein said third wireless personal area network node device is capable of being located at a location covered by both said first and second wireless personal area network node devices.

20. The system according to claim 14, further comprising a user mobile telephone terminal provided with a wireless personal area network node device, wherein said vehicle wireless personal area network node device, after leaving said wireless personal area network, is capable of associating with said user mobile telephone terminal to communicate information received by said second wireless personal area network node device.

21. A method for detecting a moving vehicle within a predetermined area by means of at least a first wireless personal area network node device and a second wireless personal area network node device and a third wireless personal area network node device, wherein said moving vehicle carries a vehicle wireless personal area network node device, wherein said first wireless personal area network node device and said second wireless personal area network node device and said third wireless personal area network node device belong to one wireless personal area network, wherein said first wireless personal area network node device covers a first area and said second wireless personal area network node device covers a second area corresponding to said predetermined area and said third wireless personal area network node device covers a third area, said first and second and third areas being sized and located so that a vehicle to be detected enters said first area before entering said third area and before entering said second area, comprising the steps of:

A) when entering said first area with said vehicle, said vehicle wireless personal area network node device discovers said wireless personal area network through said first wireless personal area network node device and prepares for joining said wireless personal area network through said third wireless personal area network node device;

B) when entering said third area with said vehicle, said vehicle wireless personal area network node device joins said wireless personal area network through said third wireless personal area network node device;

C) when entering said second area with said vehicle, said vehicle wireless personal area network node device transmits information to said second wireless personal area network node device, wherein said preparing comprises reducing a stand-by period of said vehicle wireless personal area network node device; and D) when leaving said wireless personal area network, said vehicle wireless personal area network node device leaves through said third wireless personal area network node device;

wherein said wireless personal area network node device is said second wireless personal area network node device that transmits said information through said third wireless personal area network node device; and wherein, during the time between step C and step D, a wireless personal area network node device of said wireless personal area network transmits to said vehicle wireless personal area network node device information to be used by the vehicle or to be provided to a user, whereby the detection of said moving vehicle within said predetermined area corresponds at least to the reception of said information by said second wireless personal area network node device.

* * * * *